US005921837A

United States Patent [19]

Kanagawa et al.

[11] Patent Number: 5,921,837

[45] Date of Patent: Jul. 13, 1999

[54] METHOD AND DEVICE FOR ASSEMBLING A FLAT DISPLAY SCREEN

[75] Inventors: Shinji Kanagawa, Montpellier; Maurice Lobet, St Jean de Vedas; Jean-Marc Sol, Montpellier; Stéphane Mougin, Castelnau Le Lez, all of France

[73] Assignee: Pixtech S.A., Rousset, France

[21] Appl. No.: 08/956,843

[22] Filed: Oct. 23, 1997

Related U.S. Application Data

[30] Foreign Application Priority Data

Oct. 25, 1996 [FR] France ..... 96 13282

[51] Int. Cl.[6] ..... H01J 9/40

[52] U.S. Cl. ..... 445/25; 445/66

[58] Field of Search ..... 445/23, 25, 43, 445/66

[56] References Cited

U.S. PATENT DOCUMENTS 2,882,116 4/1959 Williams ..... 445/43

4,407,658 10/1983 Bernot et al. ..... 445/25

5,697,825 12/1997 Dynka et al. ..... 445/25

FOREIGN PATENT DOCUMENTS 11524 1/1991 Japan ..... 445/25

*Primary Examiner*—Kenneth J. Ramsey

*Attorney, Agent, or Firm*—Arthur L. Plevy

[57] ABSTRACT

The present invention relates to a method and device for assembling two elements spaced apart by means of a peripheral seal, consisting of adding a seal on a surface of a first element facing a surface to be assembled of a second element, bringing the assembly thus constituted, in vacuum conditions, to a temperature enabling the melting of the seal while temporarily maintaining, by means of spacers having a thickness higher than the thickness of the seal and distributed outside the seal, the surface of the second element distant from the seal, and enabling the elements to come closer to each other to assemble them, sealably, by means of the melting seal.

9 Claims, 2 Drawing Sheets

METHOD AND DEVICE FOR ASSEMBLING A FLAT DISPLAY SCREEN

BACKGROUND OF THE INVENTION

1. Field of the Invention

The present invention relates to a flat display screen. It more specifically applies to the assembling of two plates forming the bottom and the surface of the screen, and between which an internal space isolated from the outside is provided.

2. Discussion of the Related Art

Conventionally, a flat screen is formed of two external generally rectangular spaced plates, for example made of glass. One plate forms the screen surface while the other forms the bottom of the screen generally provided with the emission means. These two plates are assembled by means of a sealing gasket. For a field effect display (FED) or a microtip display, or for a vacuum fluorescent display (VFD), vacuum is made in the space separating the two glass plates.

FIG. 1 schematically shows in cross-sectional view the conventional structure of a microtip screen.

Such a microtip screen is essentially formed, on a first substrate 1, for example, made of glass, of a microtip cathode and of a grid. In FIG. 1, the cathode/grid assembly is designated with common reference 2. Cathode/grid 2 is placed opposite to a cathodoluminescent anode 3 made on a second transparent substrate 4, for example in glass, which forms the screen surface.

Cathode/grid 2 and anode 3 are made separately on the two substrates, or plates, 1 and 4, then assembled by means of a peripheral sealing gasket 5. An empty space 6 is formed between the two plates 1 and 4 to enable the circulating of the electrons emitted by the cathode towards anode 3.

The assembly of plates 1 and 4 is conventionally performed as follows.

First, spacers 7 for defining empty space 6 are glued onto cathode/grid 2. These spacers 7 are generally formed of glass balls regularly distributed so that spacing 6 between plates 1 and 4 is constant.

Then, cathode/grid 2 is submitted to a thermal vacuum processing having the purpose of degassing the cathode and evaporating the glue of spacers 7. A similar processing, not necessarily performed in vacuum conditions, is applied to anode 3.

According to a first conventional assembly method, a pumping tube 8 is provided on the free surface of first plate 1. This tube 8 is, for example, in glass, and is sealed, by one of its open ends, above a hole made in plate 1 to establish a communication with space 6. This tube 8 will be used in particular to create vacuum in space 6. Tube 8 is placed at a corner of plate 1 outside its useful surface. Then, a seal 5, for example a fusible glass cord, is deposited on the circumference of plate 1 or 4. Both plates 1 and 4 are then assembled by being pressed against each other, cathode/grid 2 facing anode 3, and this assembly being submitted to a temperature enabling the melting of cord 5. The structure obtained is then submitted, via tube 8, to a hot pumping which has the function of degassing space 6. This degassing is necessary, in particular, because of the gases emitted by fusible glass cord 5 during the sealing of the plates. Tube 8 is then closed at its free end after introducing therein a getter 9. The function of getter 9 is to absorb any contamination likely to appear during the subsequent operation of the screen. In FIG. 1, tube 8 has been shown as closed, that is, once the screen is completed.

A disadvantage of such an assembly method is that the necessary use of a pumping and getter hosting tube causes a bulk problem for the screen.

To overcome this disadvantage, methods of vacuum assembly of a microtip screen have been provided.

FIG. 2 is a lateral view illustrating a conventional method of vacuum assembly of a microtip screen.

In such a process, plates 1 and 4 are maintained in vacuum conditions since their respective degassing thermal processings and are placed against each other with an interposed fusible glass seal 5'. The peripheral fusible glass seal, or frame, 5' exhibits, before assembly, irregular surfaces of contact with plates 1 and 4. The whole is maintained under pressure, for example, by means of pliers 10. The whole as shown in FIG. 2 is then submitted to a temperature which enables the softening of frame 5' while remaining lower than its melting temperature. At such a softening temperature, the leaks 12 linked with the irregular surfaces of frame 5' are meant to enable an outlet of the gases emitted by the fusible glass frame inside the screen before the glass sealably assembles the two plates during its melting. This melting of frame 5' is obtained by bringing the whole to a temperature higher than the melting temperature of frame 5', which then causes, under the effect of the pliers, a crushing of frame 5' and the assembly of the screen, the distance between the plates being fixed by the spacers. A disadvantage of such a method is that it does not enable to completely eliminate the gases emitted by cord 5'. Indeed, the fusible glass continues to degas when brought from its softening temperature to its melting temperature.

SUMMARY OF THE INVENTION

The present invention aims at overcoming the disadvantages of conventional methods of assembly of a flat display screen, by providing a method and a device of vacuum assembly which enables to optimize the elimination of the emitted gases, within the screen, by the seal during the assembly of the screen.

To achieve this object, the present invention provides a method of vacuum assembly of two elements spaced by means of a peripheral seal, including the following steps:

- positioning a seal on a surface of a first element facing a surface to be assembled of a second element;
- bringing the assembly thus constituted, in vacuum conditions, to a temperature enabling the melting of the seal while temporarily maintaining, by means of spacers having a thickness higher than the thickness of the seal and distributed outside the seal, the surface of the second element distant from the seal; and
- authorizing the elements to come closer to each other to assemble them, sealably, by means of the melting seal.

According to an embodiment of the present invention, the material constitutive of the temporary hold spacers has a melting temperature substantially higher than the melting temperature of the seal.

According to an embodiment of the present invention, the material constitutive of the temporary spacers has a thermal expansion coefficient close to that of the material constitutive of the seal.

According to an embodiment of the present invention, the elements to be assembled are formed of two parallel plates respectively forming the bottom and the surface of a flat display screen, an internal space being left between the two plates by means of spacers set permanently on one of the plates before assembly.

According to an embodiment of the present invention, the method includes the following steps:

placing a first plate on a first platen of substantially greater size;

hanging a second plate to a second platen similar to the first platen;

bringing the second plate opposite to the first plate, the platens being spaced apart from each other by means of temporary spacers arranged, each, between two small plates, the external surfaces of which respectively bear against the first and second platens;

bringing the assembly thus constituted to a temperature enabling the melting of the seal for a duration sufficient to enable the degassing of the material constitutive of the seal; and increasing the temperature, at least locally at the level of the temporary spacers, until the spacers melt to cause, under the action of mechanical pressure means, the platens to come closer to each other and the plates to seal one against the other.

According to an embodiment of the present invention, the first element is formed of a plate of a flat display screen, the second element being formed of a chamber for defining, with the plate, a space for receiving a getter communicating with the inside of the screen.

The present invention also provides a device for assembling two parallel plates respectively forming the bottom and the surface of a flat display screen, this device including:

a first platen for receiving a first plate;

a second platen for receiving, by suspension, a second plate;

temporary spacing means for maintaining the platens spaced apart from each other with a distance sufficient to maintain the plates spaced apart with a spacing higher than the thickness of a peripheral gasket for sealing the plates together; and means for exerting a mechanical pressure on the platens towards each other.

According to an embodiment of the present invention, each temporary spacing means is formed of two small plates, each bearing against the internal surface of a platen and separated from each other by a fusible spacer.

According to an embodiment of the present invention, the device further includes localized heating means of the fusible spacers.

The foregoing objects, features and advantages of the present invention, will be discussed in detail in the following non-limiting description of specific embodiments, in conjunction with the accompanying drawings.

DETAILED DESCRIPTION

Figure 1:
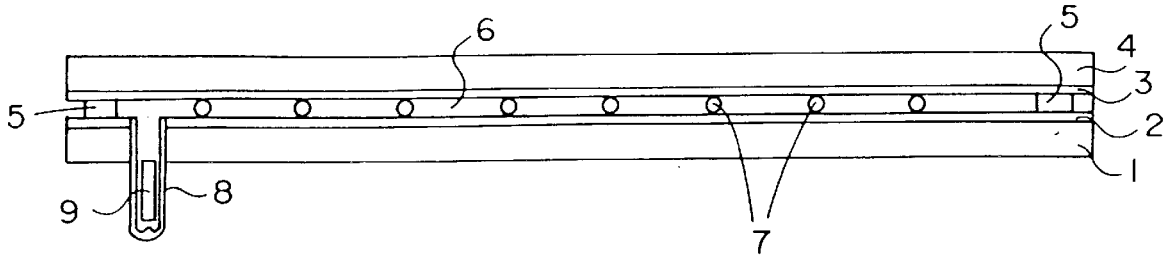
FIGS. 1 and 2, previously described, are meant to show the state of the art and the problem to solve.

The same elements have been referred to with the same references in the different drawings. For clarity, the representations of the drawings are not to scale and only those elements necessary to the understanding of the present invention have been shown in the drawings and will be described hereafter.

A characteristic of the present invention is to enable a melting of a seal of the screen without any contact of the two plates to be assembled with the seal. Thus, the degassing of the material constitutive of the seal can be entirely performed before the melting material sealably assembles the two plates together.

Figure 3A:
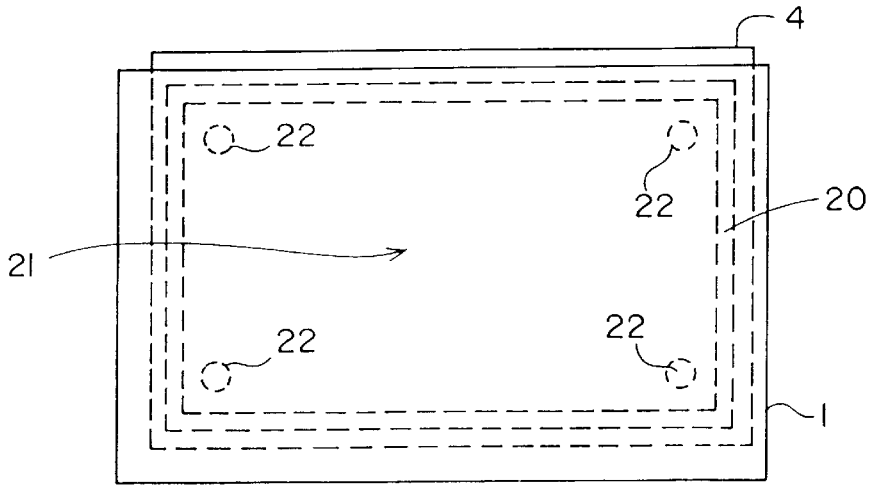
FIGS. 3A and 3B schematically show, respectively in top view and in cross-sectional view, a flat display screen being assembled according to a first embodiment of the present invention.
Figure 3B:
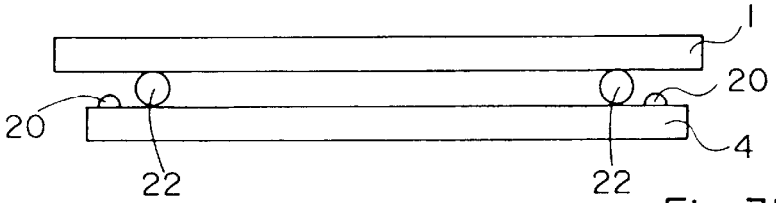

FIGS. 3A and 3B illustrate, respectively with a top view and a cross-sectional view of a flat display screen, a first embodiment of the assembly method according to the present invention.

The method according to the present invention applies to a plate 1 on which a cathode/grid (not shown) has been previously made and to a plate 4 on which an anode (not shown) has been previously made. The method according to the present invention relates to the assembly under vacuum conditions of plates 1 to 4 at a distance set by spacers (7, FIG. 1).

Plates 1 and 4 are previously submitted to the degassing processings of the respective elements supported thereon before being assembled, under vacuum conditions, by the implementation of the method according to the present invention.

Figure 2:
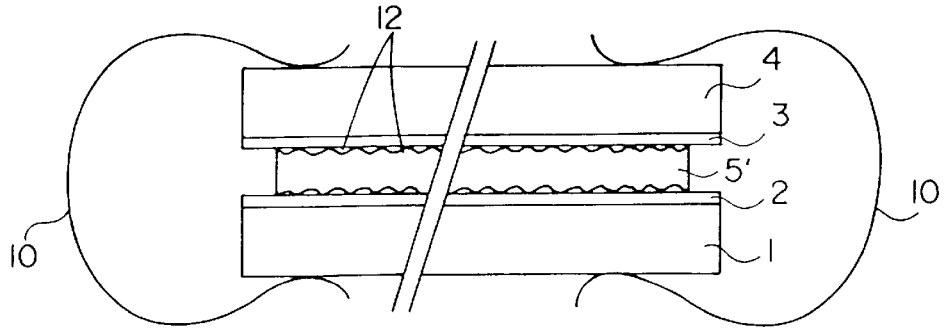

According to the first embodiment of the present invention, a seal 20, preferably in fusible glass, is deposited on the internal circumference of a plate of the screen to be assembled (for example, anode plate 4). Seal 20 is, for example, formed of rods, glued to plate 4 and distributed to form a peripheral frame external to an active area 21 of the screen, or is formed of fritted glass deposited on plate 4. This step of deposition of seal 20 is similar to the step preliminary to the assembly of the screen of the conventional method described in relation with FIGS. 1 and 2. Spacers, for example, glass balls (not shown) have been previously glued to the surface of one of plates 1 and 4 to guarantee the regularity of the space between the electrodes after assembly of the screen.

According to the present invention, a small number of temporary spacers 22 is distributed on the internal surface of plate 4, for example, between active area 21 and seal 20. Spacers 22 have a greater height than the height of seal 20 such as deposited on plate 4, that is, before assembly. Spacers 22 are, for example, formed of glass balls distributed at each corner of the screen.

A characteristic of this embodiment is that the glass constitutive of balls 22 has a melting temperature higher than the melting temperature of the glass constitutive of seal 20.

Cathode plate 1 is then disposed above anode plate 4 and, before assembly, the structure shown in FIGS. 3A and 3B is obtained.

According to the present invention, the assembly thus constituted is brought, in vacuum conditions, to a temperature higher than the melting temperature of seal 20 but lower than the melting temperature of spacers 22. The assembly is thus maintained at this temperature during the time necessary to the thorough degassing of seal 20.

Then, the assembly is brought to a temperature enabling the melting of balls 22, which causes, by means of an adapted mechanical pressure organ (for example, pliers 10), the crushing of balls 22 and the sealed closing of the screen circumference by means of seal 20. The height of the space between electrodes is defined by the height of spacers (not shown), the melting temperature of which is still higher.

An advantage of the present invention according to this embodiment is that the gases which remain inside the screen and which result from the degassing of the glass elements are limited to those resulting from the melting of balls 22. Thus, the amount of degassing product contained inside the assembled screen is considerably reduced.

It should be noted that the sole fact of using balls 22 thicker than seal 20 leads to their melting temperature being higher than the melting temperature of seal 20. However, it is preferred to make temporary spacers 22 in a different material (a glass) intrinsically having a melting temperature higher than that of the material constitutive of seal 20. It will however be provided that the two materials have close thermal expansion coefficients.

As a specific example, the glass constitutive of seal 20 has a softening temperature included between around 300 and 350° C. and a melting temperature included between 450 and 500° C. The glass constitutive of temporary spacers 22 has a softening temperature included between about 400 and 450° C. and a melting temperature included between about 550 and 600° C.

An advantage of providing, for seal 20, a melting temperature higher than the softening temperature of balls 22 is that it further reduces the amount of gases present inside the screen after assembly. Indeed, balls 22 are then submitted to a previous degassing during the degassing of seal 20 at its melting temperature.

Preferably, spacers 22 are distributed outside cord 20, which further reduces the amount of gas inside the screen after assembly.

It should be noted that, if temporary spacers 22 are placed outside seal 20, it can be provided that the screen is made on plates 1 and 4 of sizes clearly higher than the effective surface of the screen in order to push away balls 22 from seal 20 and thus minimize the amount of gas, inside the screen, due to the melting of balls 22. The screen is then cut again, after assembly, between seal 20 and balls 22 to give it its final size, for example with a diamond saw.

As a specific example of implementation, the spacers (not shown) distributed between plates 1 and 4 have a height of 0.2 mm. Fusible glass seal 20 has, before thermal processing, a height of 0.4 mm. Temporary balls or spacers 22 have, before thermal processing, a height of around 0.8 to 1.2 mm.

Figure 4:
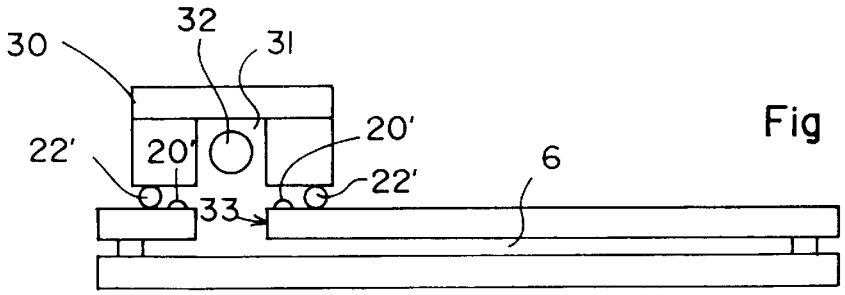
FIG. 4 shows, schematically and in cross-sectional view, a flat display screen illustrating a second embodiment of the method according to the present invention.

FIG. 4 shows, in cross-sectional view, a flat display screen according to a second embodiment of the present invention.

According to this embodiment, the method of the present invention is applied to the sealing of a chamber 30 added to the external surface of a screen plate and defining, with this plate, an internal space 31 of reception of a getter 32. Chamber 30 is arranged above an opening 33 of communication with inter-electrode space 6. Chamber 30 can have various shapes such as an elongated shape according to one direction of the screen or at right angle along two directions of the screen.

A seal, for example, a fusible glass frame 20' is disposed at the periphery of opening 32. Temporary spacers 22', for example balls, of a height greater than the height of frame 20' are distributed in limited number, preferably, outside frame 20'. The melting temperature of the material, for example glass, constitutive of spacers 22' is higher than the melting temperature of frame 20'.

According to this embodiment of the present invention, plates 1 and 4 can have been previously assembled conventionally, with inter-electrode space 6 being degassed upon assembly of chamber 30 on plate 4. As an alternative, plates 1 and 4 can be assembled simultaneously by implementing the method according to the first embodiment described in relation with FIGS. 3A and 3B.

Figure 5:
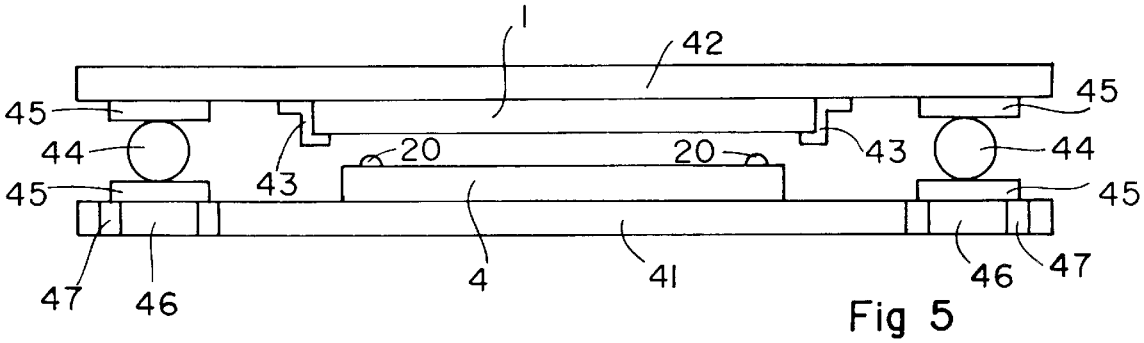
FIG. 5 shows an embodiment of a device for assembling a flat display screen according to the present invention.

FIG. 5 shows an embodiment of an assembling device according to the present invention.

Such a device is formed of two platens 41 and 42 for respectively supporting anode plate 4 and cathode plate 1 of a flat display screen to be assembled. One of the two platens (for example, platen 42) includes movable means 43 of suspension of one of the plates (for example, plate 1).

This assembling device implements an alternative of the method illustrated by FIGS. 3A and 3B.

According to this embodiment, temporary spacers 44 in a material having a melting temperature higher than that of seal 20 appended to the internal surface of one of the plates (for example, anode plate 4) are distributed outside plates 1 and 4 between platens 41 and 42. Spacers 44 (for example, fusible glass balls) are framed, each, by two small plates 45, for example in glass, bearing on the internal surfaces of platens 41 and 42. Two small plates 45 associated with a fusible spacer 44 form a temporary and single use means of spacing apart of plates 1 and 4. The global thickness of two associated small plates 45 is, according to the present invention, at most equal to the thickness of plates 1 and 4 to be assembled.

Once the assembly preparations shown in FIG. 5 are finished, the assembly is brought to a temperature higher than the melting temperature of seal 20 to enable its degassing. Since spacers 44 have a height substantially higher than the height of seal 20 and a melting temperature substantially higher than the melting temperature of seal 20, they maintain a sufficient spacing between plate 1 and seal 20 to enable the outlet of the gases issued from the melting of seal 20.

Once the degassing is completed, the temperature is increased until obtaining the melting of spacers 44 which crush under the action of a mechanical pressure means (not shown) pressing platens 41 and 42 against each other, which causes the assembly of plates 1 and 4 with the definition of the inter-electrode space by means of conventional spacers (not shown).

After cooling down, cathode plate 1 is detached from supports 43, which enables to extract the assembled screen from the assembly device. The small plates 45 sealed by spacers 44 are themselves extracted from the assembly device since these small plates 45 are not attached to platens 41 and 42. To assemble a new screen by means of the assembly device, new small plates 45 and new spacers 44 are used by repeating the steps described hereabove.

An advantage of the assembling device according to the present invention and of the embodiment of the method associated therewith is that temporary spacers 44 can be sufficiently spaced away from the screen to be assembled to prevent any presence of gas, due to the melting of these spacers 44, inside the screen.

Another advantage is that the corresponding embodiment of the method according to the present invention requires no additional surface of plates 1 and 4 with respect to a conventional screen to arrange the temporary spacers.

Another advantage of this embodiment is that it provides a greater freedom for the material and the size of temporary spacers 44. Indeed, the glass constitutive of balls 44 no longer requires to have a thermal expansion coefficient close to that of seal 20. Further, since balls 44 no longer degas inside the screen, they can be of greater size, which further improves the degassing of seal 20 by increasing the interval between plates 1 and 4 during this degassing.

As a specific example of implementation, and for the same dimensions of the spacers and seal as in the example described in relation with FIGS. 3A to 3C, balls 44 can have a height included between 2 and 4 mm, small plates 45 having a thickness of around 0.2 to 1 mm.

As an alternative, the melting of spacers 44 is obtained by heating means localized at the level of these spacers. An advantage of this alternative is that the degassing of seal 20 is further reduced during the closing of the screen since it is no longer brought to the melting temperature of spacers 44 upon sealing. The localized heating means are, for example, formed of heating resistors 46 housed in the thickness of at least one of the platens (for example, platen 41) at the level of small plates 45. Preferably, these resistors 46 are laterally surrounded with a thermal insulator 47 to minimize thermal propagation towards the screen. In this case, the temperature of the assembly can be lowered back, while remaining higher than the melting temperature of cord 20, before causing the melting of spacers 44 by the localized heating means.

An advantage of the present invention, whatever the embodiment described hereabove, is that it minimizes the gases present inside the screen and resulting from the degassing of the assembly elements, while enabling an assembly of the screen under vacuum conditions and without requiring, after assembly, a pumping from the outside.

Of course, the materials constitutive of the seal and of the temporary spacers are chosen to be compatible with the materials constitutive of elements 1 and 4 (or 4 and 30) to be assembled, spacers defining the internal space 6 and, in some cases, single-use small plates 45. In particular, their melting temperatures must be lower than the softening temperatures of the elements to be assembled, of the spacers and of the possible small plates.

As an examplary implementation, the assembling structure is first brought to a temperature of around 380° C. for one hour. There then occurs a first degassing of seal 20 or 20' at its softening temperature. Then, the temperature is brought to about 430° C. for one hour. This temperature enables the melting of seal 20 or 20' and a thorough degassing of the glass constitutive of seal 20 or 20' at the same time as a partial degassing of spacers 22, 22' or 44 at their softening temperature. Then, the temperature is brought to about 470° C. for one hour to cause the melting of spacers 22, 22' and 44 and thus the assembling of the screen. It should however be noted that the temperatures indicated in the present description are purely indicative. Indeed, the temperatures used depend on the softening and melting temperatures of the materials constitutive of the seal and the temporary spacers, as well as on their respective thicknesses. The softening and melting temperatures also depend on the degree of vacuum under which the assembling is performed.

Figure 6A:
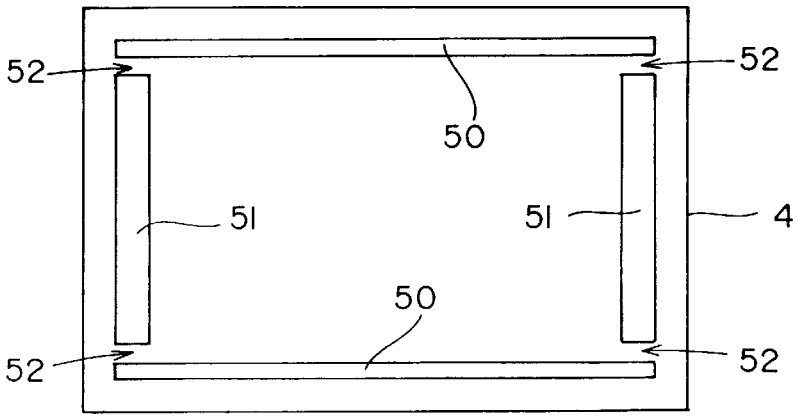
FIGS. 6A and 6B show, respectively in top view and in cross-sectional view, a flat display screen being assembled according to a third embodiment of the present invention.
Figure 6B:
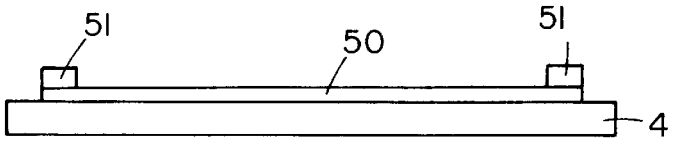

FIGS. 6A and 6B illustrate a third implementation of the method according to the present invention. These drawings show, respectively in top view and in cross-sectional view, a plate of a flat display screen before assembly.

According to this embodiment, the seal supported by one of the plates (for example, anode plate 4) is formed of two bars 50 of same thickness and of two bars 51 having a thickness higher than that of bars 50. Preferably, bars 50 are arranged in the longitudinal direction of the screen and the length of bars 51 is such that there remains, before assembly, a space 52 at each corner of the screen between the ends of bars 51 and those of bars 50.

According to this embodiment, bars 50 and 51 are formed of the same fusible glass, the melting temperature difference between bars 50 and 51 resulting from their difference in thickness only. A processing similar to that described in relation with the preceding drawings is then applied to the structure such as shown in FIG. 6, to cause the melting of bars 50 before bars 51 have reached their melting temperature. During the melting of bars 51, these bars crush to close the seal of the screen by filling spaces 52 and, as previously, the distance between plates 1 and 4 is defined by conventional spacers (not shown).

Of course, the present invention is likely to have various alterations, modifications, and improvements which will readily occur to those skilled in the art. In particular, the choice of the respective thicknesses of the seal and of the temporary spacers depends on the height of the spacers determining the inter-electrode distance. Further, the fusible glass bars used to form the peripheral seal can have irregular surfaces like in conventional assembly methods or can have smooth surfaces. Further, the number of temporary spacers distributed at the screen circumference depends, in particular, on its size and on the pressure exerted by the mechanical pressure means. Besides, if the respective softening and melting temperatures of the seal and of the spacers allow it, the temperature to which the assembly is brought to degas the seal can be higher than its melting temperature while remaining lower than the melting temperature of the spacers. The degassing of the seal is thus maximized before closing.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A method of vacuum assembly of two elements (1, 4, 30) spaced by means of a peripheral seal, including the following steps:

positioning a seal (20, 20') on a surface of a first element (4) facing a surface to be assembled of a second element (1, 30);

bringing the assembly thus constituted, in vacuum conditions, to a temperature enabling the melting of the seal (20, 20') while temporarily maintaining, by means of spacers (22, 22', 44) having a thickness higher than the thickness of the seal and distributed outside the seal, the surface of the second element (1, 30) distant from the seal; and authorizing the elements (1, 4, 30) to come closer to each other to assemble them, sealably, by means of the melting seal (20, 20').

2. The method of claim 1, wherein the material constitutive of the temporary hold spacers (22, 22', 44) has a melting temperature substantially higher than the melting temperature of the seal (20, 20').

3. The method of claim 1 or 2, wherein the material constitutive of the temporary spacers (22, 22', 44) has a thermal expansion coefficient close to that of the material constitutive of the seal (20, 20').

4. The method of any of claims 1 to 3, wherein the elements to be assembled are formed of two parallel plates (1, 4) respectively forming the bottom and the surface of a flat display screen, an internal space (6) being left between the two plates (1, 4) by means of spacers (7) set permanently on one of the plates (1, 4) before assembly.

5. The method of claim 4, including the following steps:

placing a first plate (4) on a first platen (41) of substantially greater size;

hanging a second plate (1) to a second platen (42) similar to the first plate (41);

bringing the second plate (1) opposite to the first plate (4), the platens (41, 42) being spaced apart from each other by means of temporary spacers (44) arranged, each, between two small plates (45), the external surfaces of which respectively bear against the first (41) and second plates (42);

bringing the assembly thus constituted to a temperature enabling the melting of the seal (20) for a duration sufficient to enable the degassing of the material constitutive of the seal (20); and increasing the temperature, at least locally at the level of the temporary spacers (44), until the spacers melt to cause, under the action of mechanical pressure means, the platens (41, 42) to come closer to each other and a the plates (1, 4) to seal one against the other.

6. The method of any of claims 1 to 3, wherein the first element is formed of a plate (1, 4) of a flat display screen, the second element being formed of a chamber (30) for defining, with the plate (1, 4), a space (31) for receiving a getter (32) communicating with the inside of the screen.

7. A device for assembling two parallel plates (1, 4) respectively forming the bottom and the surface of a flat display screen, including:

a first platen (41) for receiving a first plate (4);

a second platen (42) for receiving, by suspension (43), a second plate (1);

temporary spacing means (44, 45) for maintaining the platens (41, 42) spaced apart from each other with a distance sufficient for maintaining the plates (1, 4) spaced apart with a spacing higher than the thickness of a peripheral gasket (20) for sealing the plates (1, 4) together; and means for exerting mechanical pressure on the platens (41, 42) towards each other.

8. The device of claim 7, wherein each temporary spacing means is formed of two small plates (45), each bearing against the internal surface of a platen (41, 42) and separated from each other by a fusible spacer (44).

9. The device of claim 8, further including localized heating means (46) of the fusible spacers (44).

* * * * *